US005584170A

United States Patent [19]

Stahlecker

[11] Patent Number: 5,584,170

[45] Date of Patent: Dec. 17, 1996

[54] METHOD AND APPARATUS FOR DRIVING AN OPEN-END SPINNING ROTOR DURING AUTOMATIC PIECING

[75] Inventor: Gerd Stahlecker, Eislingen/Fils, Germany

[73] Assignee: Novibra GmbH, Suessen, Germany

[21] Appl. No.: 378,722

[22] Filed: Jan. 26, 1995

[30] Foreign Application Priority Data

Feb. 2, 1994 [DE] Germany ..... 44 03 120.3

[51] Int. Cl.[6] ..... D01H 13/26; D01H 13/00

[52] U.S. Cl. ..... 57/263; 57/94; 57/105; 57/264; 57/405; 57/406

[58] Field of Search ..... 57/263, 264, 405, 57/406, 407, 409, 93, 94, 100, 105

[56] References Cited

U.S. PATENT DOCUMENTS

| | | | |
|---|---|---|---|
| 3,780,513 | 12/1973 | Watanabe et al. | 57/263 X |
| 4,172,357 | 10/1979 | Stahlecker et al. | 57/263 |
| 4,893,462 | 1/1990 | Braun et al. | 57/263 X |
| 5,184,452 | 2/1993 | Stahlecker et al. | 57/263 X |

FOREIGN PATENT DOCUMENTS

| | | | |
|---|---|---|---|
| 25244209A1 | 4/1977 | Germany . | |
| 2910814 | 10/1980 | Germany | 57/263 |
| 2708936A1 | 9/1988 | Germany . | |

*Primary Examiner*—William Stryjewski
*Attorney, Agent, or Firm*—Evenson McKeown Edwards & Lenahan, PLLC

[57] ABSTRACT

In the case of a method for closed-loop controlling the revolutions of an open-end spinning rotor during automatic piecing, the spinning rotor is run up to its operating speed from a standstill by being coupled to a tangential drive belt, which runs at operating speed. The spinning rotor thereby passes through a suitable speed range for piecing, and is kept at this speed range for a predetermined time span by changes in the driving effect of the tangential drive belt. This occurs in that the revolutions of the spinning rotor are measured, and dependent on these readings, the revolutions are closed-loop controlled by device of reducing and increasing the driving effect, for example by device of intermittent activating of the rotor brake.

19 Claims, 4 Drawing Sheets

METHOD AND APPARATUS FOR DRIVING AN OPEN-END SPINNING ROTOR DURING AUTOMATIC PIECING

BACKGROUND AND SUMMARY OF THE INVENTION

The invention relates to a method for driving an open-end spinning rotor during automatic piecing, in which the spinning rotor is accelerated from a standstill to operating speed by being coupled to a tangential drive belt running at operating speed. The spinning rotor passes through a speed range suitable for a piecing, at which speed it is kept for a predetermined time span by changing the driving effect of the tangential drive belt. The invention relates further to an arrangement for carrying out this method.

In the case of a method of this kind (German published patent application 27 08 936 A1 and corresponding U.S. Pat. No. 4,172,357), control means are provided in a travelling piecing arrangement, which synchronize the devices for carrying out the piecing with each other and with the start-up phase of the previously resting spinning rotor in such a way that the piecing and drawing off of the yarn occurs during the acceleration curve of the spinning rotor. A piecing without reducing the revolutions of the entire spinning machine can be carried out in this way while still having an advantageous number of revolutions. In order to prolong the suitable speed range, the piecing device can intervene from the outside in the acceleration curve of the individual spinning rotor, for example by applying a brake. The rotational speed range best suited for piecing is thus kept constant for a predetermined time span.

It is also known (German published patent application 25 44 209 A1) that the current number of revolutions can be scanned in a non-contact way by a piecing device during the start-up phase of the spinning rotor, so that the start of the piecing program can be set in motion in dependence on the monitored starting-up behavior of the spinning rotor.

An object of the invention is to regulate the speed range of revolutions suitable for piecing in a method as mentioned above.

This object is achieved according to preferred embodiments of the invention in that the revolutions of the spinning rotor are measured and are close-loop controlled in dependence on the readings by means of reducing and increasing the driving effect of the tangential drive belt.

Contrary to the known piecing method, not only is the start-up phase of the spinning rotor prolonged and the piecing revolutions kept constant, but also the speed range suitable for piecing is closed-loop controlled for a predetermined time span. The actual number of revolutions can hereby more or less fluctuate around a set number. The test reading of the current rotor revolutions is thereby used not only to begin diverse piecing steps as in one known method, but also as a base for regulating the piecing revolutions.

In a development of the invention, a preset value of the rotational speed is given which lies in between two limiting values of the ideal speed range, to which the revolutions of the spinning rotor are matched; this is done by continuous reducing and increasing of the driving effect of the tangential drive belt. The driving of the spinning rotor is thus intermittently geared into from the outside. It is therefore advantageous according to preferred embodiments that the preset value of revolutions is maintained at least almost constant during the predetermined time span, which does not however rule out that the preset value of revolutions chosen for piecing cannot slowly increase during the predetermined time span. In a development of the invention, the driving effect of the tangential drive belt is reduced or increased by the intermittent activation of a rotor brake on the spinning rotor. The rotor brake already provided and used for bringing the spinning rotor to a standstill or considerably reduce the number of its revolutions, for example for a cleaning procedure before piecing, is used for this purpose. According then to this version of the invention, the rotor brake is repeatedly activated and released. The pressure of the tangential drive belt on the spinning rotor can, in conjunction with the rotor brake, also be changed intermittently, for example by means of repeated relieving and charging of the tension pulley.

In especially preferred embodiments for carrying out the method on an open-end rotor spinning machine, a travelling piecing device is provided, which travelling piecing device can be selectively placed at a spinning unit. The spinning unit comprises a spinning rotor driven by a tangential drive belt as well as an accompanying rotor brake. It is provided that a plotting arrangement and an accompanying servo component for proportional speed signals produced at the spinning unit are arranged at the piecing device, which servo component can be coupled with devices for activating the rotor brake. The piecing device thus uses components already positioned at every spinning unit to regulate the piecing revolutions.

Other objects, advantages and novel features of the present invention will become apparent from the following detailed description of the invention when considered in conjunction with the accompanying drawings.

DETAILED DESCRIPTION OF THE DRAWINGS

Figure 1:
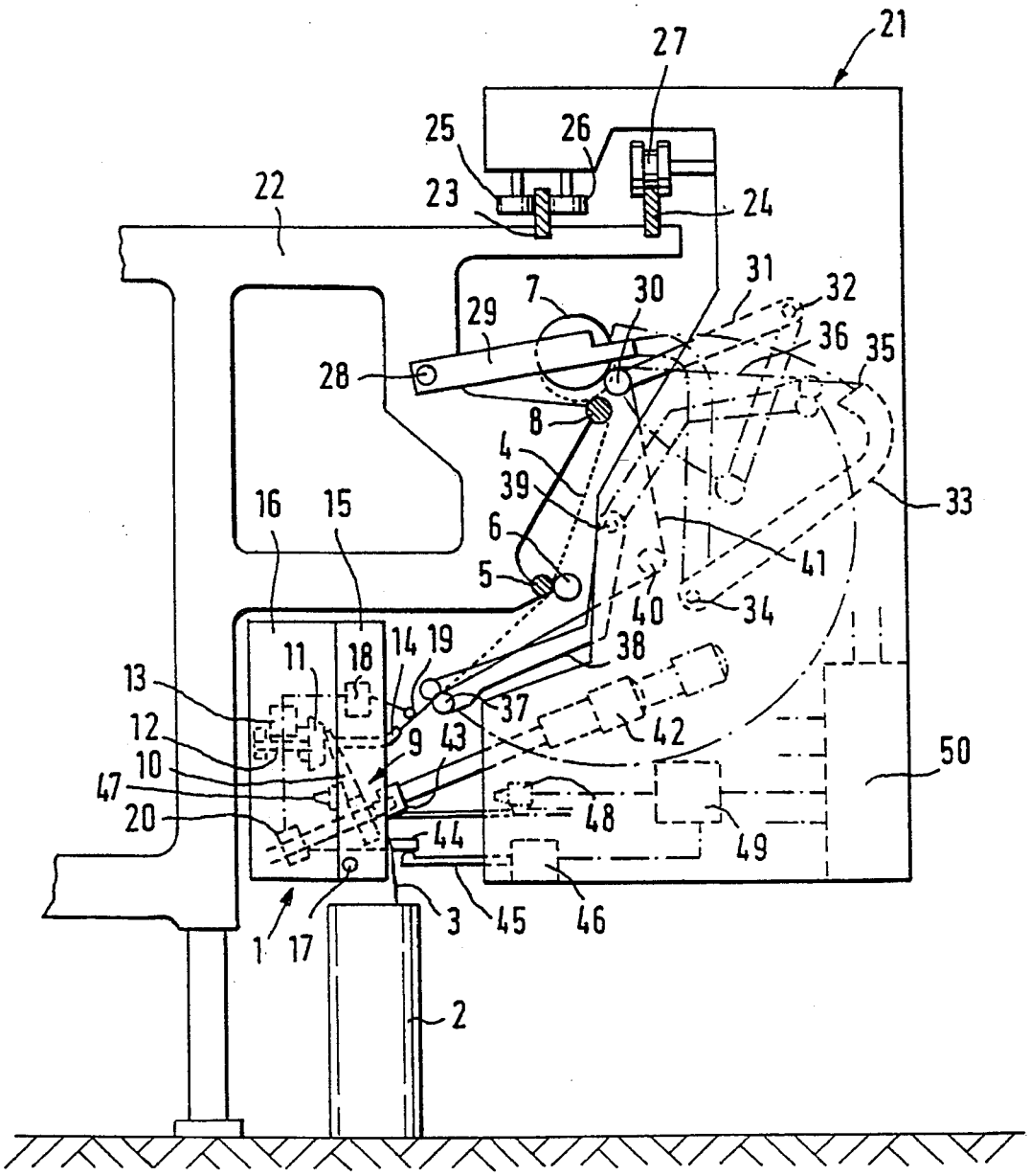
FIG. 1 shows in diagrammatic view a cross section through an open-end rotor spinning machine in the area of the spinning aggregate and an accompanying travelling piecing device for carrying out a piecing method constructed according to a preferred embodiment of the present invention.

The spinning aggregate 1 shown only in diagrammatic view is only one of a plurality of spinning aggregates which are arranged one beside the other on both sides of a rotor spinning machine and which are all similarly constructed. Each spinning aggregate 1 is fed a sliver 3 from a can 2, which is spun to a yarn 4 inside the spinning aggregate 1 during operation, the yarn 4 represented by a broken line. The yarn 4 is withdrawn from the spinning aggregate 1 by means of a withdrawing device containing a driving cylinder 5 which extends in longitudinal direction of the open-end rotor spinning machine, and a top roller 6 arranged at each spinning aggregate 1. Finally the yarn 4 is fed to a package 7, which is driven during operation (shown by the broken line) by a driving cylinder 8 extending in longitudinal direction of the machine.

The diagram in FIG. 1 shows however a state at the spinning aggregate 1 in which the yarn 4 is broken, so that it is not being withdrawn. Due to this condition the package 7 is shown raised from the driving cylinder 8.

Each spinning aggregate 1 comprises a feeding and an opening device 9 for the sliver 3. There the individual fibers, opened in a known way, are transported through a fiber feed channel 10 to a spinning rotor 11. A shaft 12 of the spinning rotor 11 is supported by a bearing arrangement which is only outlined in FIG. 1 and driven by a tangential drive belt (not shown in FIG. 1) which is pressed onto the shaft 12 by means of a tension pulley 13.

In the spinning rotor 11, the fed-in fibers collect in a known way in a fiber collecting groove, from which, in the form of the yarn 4, they are drawn off through a yarn withdrawal duct 14. The yarn withdrawal duct 14 is located in a part of housing 15, which is pivotably connected with a main housing 16. By swivelling the part of housing 15 around a swivel axle 17, the spinning rotor 11 can be exposed for a maintenance procedure, for example cleaning before piecing.

A thread guard switch 18 is arranged at every spinning aggregate 1, which detects the presence of yarn 4 with a thread detector 19. The thread guard switch 18 is connected by a power line to an electromagnetic clutch 20, which opens when a yarn breakage is detected by the thread guard switch 18. The further feeding of the sliver 3 into the spinning aggregate 1 is thus interrupted.

After a thread breakage at the spinning aggregate 1, automatic piecing is carried out by a travelling piecing device 21, which can be selectively positioned at the spinning aggregate 1. Here, as in the representation of the spinning aggregate 1, only the components relevant to understanding the invention in question are illustrated and explained. The spinning aggregate 1 as well as the piecing device 21 of course comprise in practical construction further components which are not described here. For example, the piecing device 21 comprises an arrangement not shown here for swivelling the part of housing 15 and thus for exposing the spinning rotor 11; also not shown are arrangements for cleaning the spinning rotor 11. These measures known in prior art will not be detailed in the following description so as not to obscure the present invention.

Running rails 23 and 24 are arranged above the machine frame 22, on which the piecing device 21 is supported and driven by means of running wheels 25, 26 and 27. At least one running wheel, for example running wheel 27, comprises a drive, which brings the piecing device 21 to a spinning aggregate 1 needing maintenance and positions it there.

After a yarn breakage, the piecing device 21 takes over the broken yarn end from the package 7. The package 7 is supported in a creel 29, which creel can be swivelled around a stationary axle 28, so that the package 7 can be raised from the driving cylinder 8. An auxiliary winding roller 30 is positioned at the piecing device 21 for raising the package 7, which auxiliary winding roller is arranged on an arm 31: the arm 31 being pivotable around an axle 32 of the piecing device 21. The auxiliary winding roller 30 is provided with a driving motor which can be switched to drive in both directions of rotation; the auxiliary winding roller 30 being pivotal from a waiting position shown by a broken line to the package 7.

A yarn search nozzle 33 of the piecing device 21 can be placed at the raised package 7, which search nozzle 33 is pivotable around an axle 34. The yarn search nozzle 33 takes over the broken yarn from the package 7 with its mouth 35 (see broken-lined position). Then the yarn search nozzle 33 is swivelled back around the axle 34, whereby it takes a yarn end 36 with it, shown in a broken-lined representation, which then extends between the package 7 and the mouth 35 of the yarn search nozzle 33. While the yarn search nozzle 33 is being swivelled back, the auxiliary winding roller 30 is driven in the winding off direction of the package 7.

Then a yarn transfer arrangement is placed at the yarn end 36, which arrangement comprises a pair of nipping rollers 37 which are arranged on an arm 38, which can be pivoted around an axle 39 of the piecing device 21. The nipping roller pair 37 takes over the yarn end 36 at the position shown by a broken line, whereby the nipping roller pair 37 is first opened and then closed. A cutting device (not shown) is arranged in the area of the mouth 35 of the yarn search nozzle 33, which cuts the yarn end 36 near the yarn withdrawal duct 14 before the nipping roller pair 37 is pivoted. The auxiliary winding roller 30 is also driven in the winding off direction of the package 7 while the arm 38 is pivoted.

After the nipping roller pair 37 has been pivoted, the separated yarn end lies opposite the yarn withdrawal duct 14. During pivoting the yarn withdrawn from the package 7 is laid around a thread guide 40 of the piecing device 21 so that the yarn follows the intended course marked with the reference number 41 between the area of the yarn withdrawal duct 14 and the package 7, the said package 7 lying on the auxiliary winding roller 30. The yarn end, located opposite the yarn withdrawal duct 14, is sucked in up to the spinning rotor 11 by a prevailing vacuum in the area of the spinning rotor 11, whereby the nipping roller pair 37 and the auxiliary winding roller 30 are driven in the winding-off direction of the package 7.

For piecing, a fiber ring must be produced in the spinning rotor 11. For this purpose, the piecing device 21 is provided with an auxiliary drive 42, to which a driving wheel 43 is attached; the driving wheel 43 can be applied to the feeding and opening device 9 of the spinning aggregate 1. This driving wheel 43 can be coupled with a feeding roller (not shown in FIG. 1), which is a part of the feeding and opening device 9. In the case of a yarn breakage, the interrupted drive for the feeding of sliver 3, controlled by the piecing device 21, can thus be temporarily switched on externally.

The auxiliary drive 42 and the driving wheel 43, apart from producing a fiber ring for the purpose of piecing, can also be used to control a combed-out fiber beard on the feeding and opening device 9 by short-term switching on and off of the feeding roller.

The piecing of the broken yarn takes place during the run-up phase of the previously stopped spinning rotor 11. A rotor brake, not recognizable from FIG. 1 but which will be described later, is used to stop the spinning rotor 11; this is activated by a brake lever 44, which projects out of the spinning aggregate 1 towards the side of the piecing device 21. By raising the brake lever 44, the rotor brake is activated, stopping the spinning rotor 11 or at least reducing its speed.

An activating lever 45 of the piecing device 21 can be applied to the brake lever 44 from underneath. The activating lever 45 can be raised upwards on the side towards the brake lever 44, whereby the rotor brake is activated. By lowering the activating lever 45, the rotor brake can be disengaged, whereby the spinning rotor 11 is run up to its operational speed by the tangential drive belt which is still running at operational speed. The actual piecing of the broken end onto the fiber ring located in the spinning rotor 11 takes place during the run-up of the spinning rotor 11, that is, the last part of the process of feeding back the yarn end into the spinning rotor 11 and the withdrawing of the pieced thread. The actual piecing can be particularly advantageously carried out when the spinning rotor 11 has a speed which is significantly lower than the operating speed. In order that the spinning rotor 11 does not have to be provided with a special drive to achieve a piecing speed, the piecing takes place during the starting-up phase of the spinning rotor 11 when it is run up from a braked position.

Because there are a number of procedural steps to be carried out during the starting-up phase of the spinning rotor 11, it is wise to lengthen the starting-up phase. This can be achieved with the aid of the activating lever 45, which, in a way to be described later, intermittently activates the rotor brake. To this purpose, the activating lever 45 is controlled by an electric motor 46.

According to the invention, it is intended to measure the speed of the spinning rotor 11 during the run-up phase and, in dependence on these readings, to regulate the piecing speed by means of reducing and increasing the driving effect of the tangential drive belt. To this purpose an impulse receiver 47 of the piecing device 21 is advanced to a component, rotating proportionally with the spinning rotor 11; this will be explained in detail later. When not in use, this impulse receiver 47 takes up the position 48 on the inside of the piecing device 21. The impulse receiver 47, as will be explained later, is connected to a plotter 49 of the piecing device 21. The plotter 49 is connected to the electric motor 46 as well as to a control program 50, which controls the individual procedural steps of the piecing device 21 as represented by partial broken-lined diagrams of electric power lines. After completion of a piecing process, the pieced thread must be transferred back to the spinning aggregate 1, which is carried out by devices not shown here.

Figure 2:
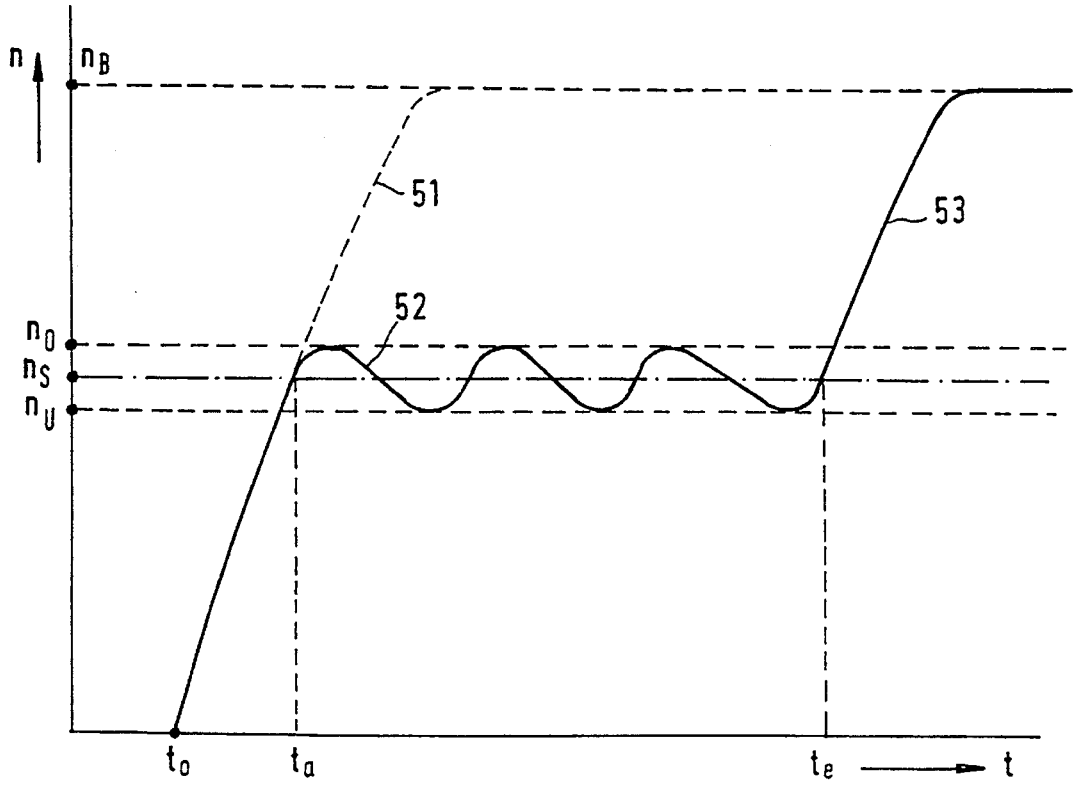
FIG. 2 shows a diagram to illustrate the starting-up behavior of a spinning rotor from standstill to operational speed with closed-loop controlling of a suitable speed range for piecing according to preferred embodiments of the present invention.

The diagram in FIG. 2 serves to show how the speed of the spinning rotor 11 during the critical piecing phase can be regulated, that is during a phase in which the yarn end, fed back into the spinning rotor 11, is pieced on to the fiber ring and drawn off. The less critical steps of the piecing procedure such as the search for the yarn end on the package 7 or the transfer of the pieced-up thread to the spinning aggregate 1, can be carried out outside of the start-up phase of the spinning rotor 11, for example when the spinning rotor 11 is at rest (thread search) or when the spinning rotor 11 is running at operational speed (transfer of thread to the spinning aggregate 1).

In FIG. 2 the rotor speed n (ordinate or y-axis) is plotted over the run-up time t (abscissa or x-axis). The broken line $n_B$ symbolizes the operational speed of the spinning rotor 11. It is assumed that the spinning rotor 11 is run up at a time $t_0$ from a braked position, for example from a complete stand-still, to its operational speed $n_B$, which occurs by being coupled to the tangential drive belt which runs constantly at operational speed. This will be described later. If no particular measures were taken, the spinning rotor 11 would run up along a curve marked by reference number 51 and shown by a broken line.

It is intended in the invention that the non-controlled rotor acceleration curve be prolonged in that it fluctuates around a preset value of the rotational speed $n_S$, which is considered a desirable piecing speed. This desired piecing rotational speed $n_s$ should be maintained at least approximately for a predetermined time span, which time span lies in between the time points $t_a$ and $t_e$. A maximum upper speed limit $n_O$ and lower speed limit $n_U$ should be permitted. The actual piecing rotational speed 52 fluctuates inside the rotational speed range between speeds $n_O$ and $n_U$, around a desired preset value of a rotational speed $n_U$, which should be regarded as a mean value of the fluctuation movement. Only from the time point $t_e$ does the spinning rotor 11 accelerate in a finishing acceleration curve 53 completely to operating speed $n_B$; this happens only by coupling with the tangential drive belt which runs at operational speed.

The wave-shaped course of the actual piecing rotational speed 52 is attained by closed-loop controlling around the preset value of the rotational speed $n_S$. To this purpose the rotational speed of the spinning rotor 11 is measured during the starting up phase; in dependence on these readings, the driving effect of the tangential drive belt is repeatedly reduced or increased. One could say that the driving force of the tangential drive belt is effected in a "stop-go" fashion, in that it is repeatedly partly interrupted and activated again.

Figure 3:
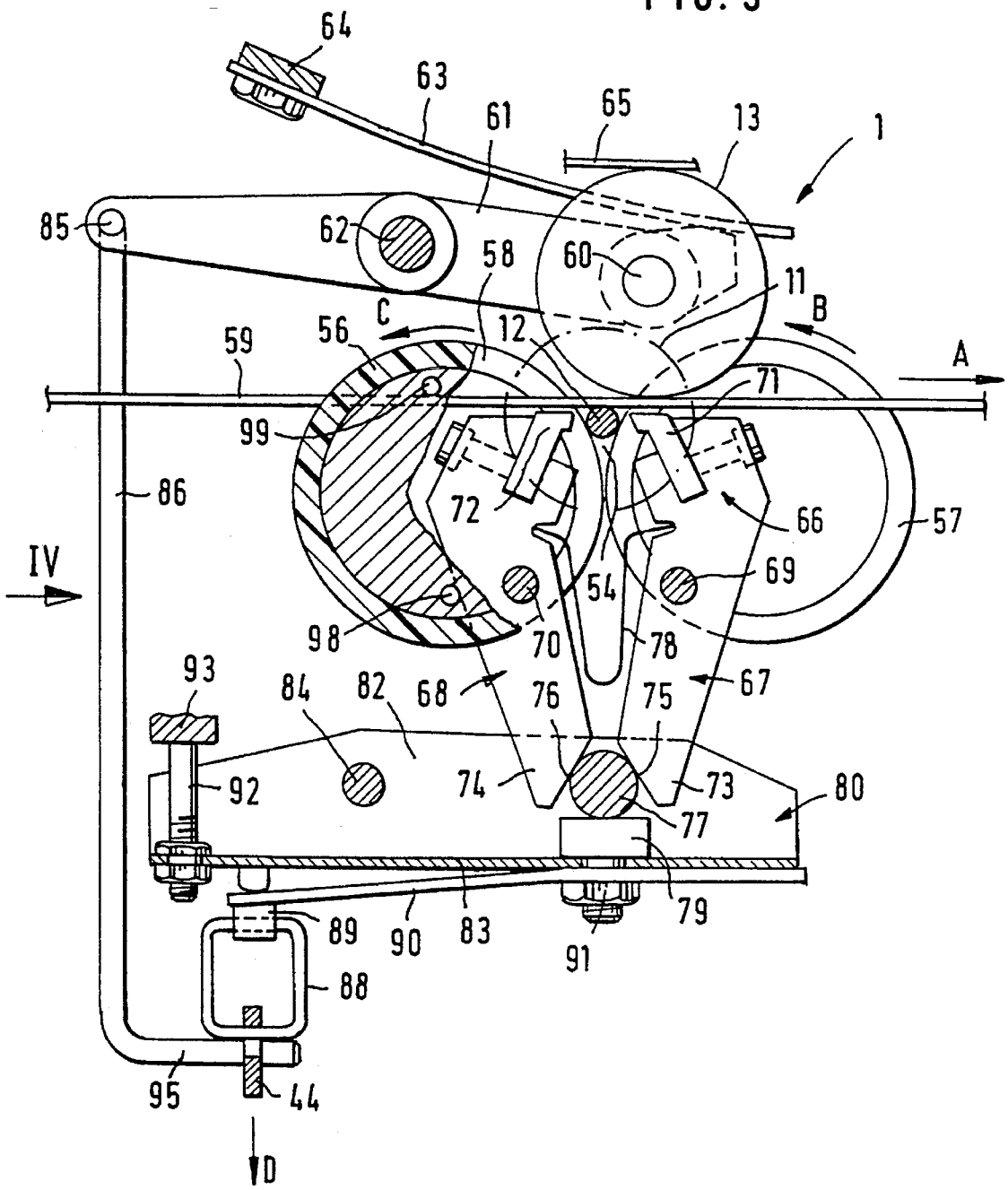
FIG. 3 shows a cross section in the area of the bearing arrangement of a spinning rotor as well as its drive and the braking means placable at it of an arrangement according to preferred embodiments of the present invention.
Figure 4:
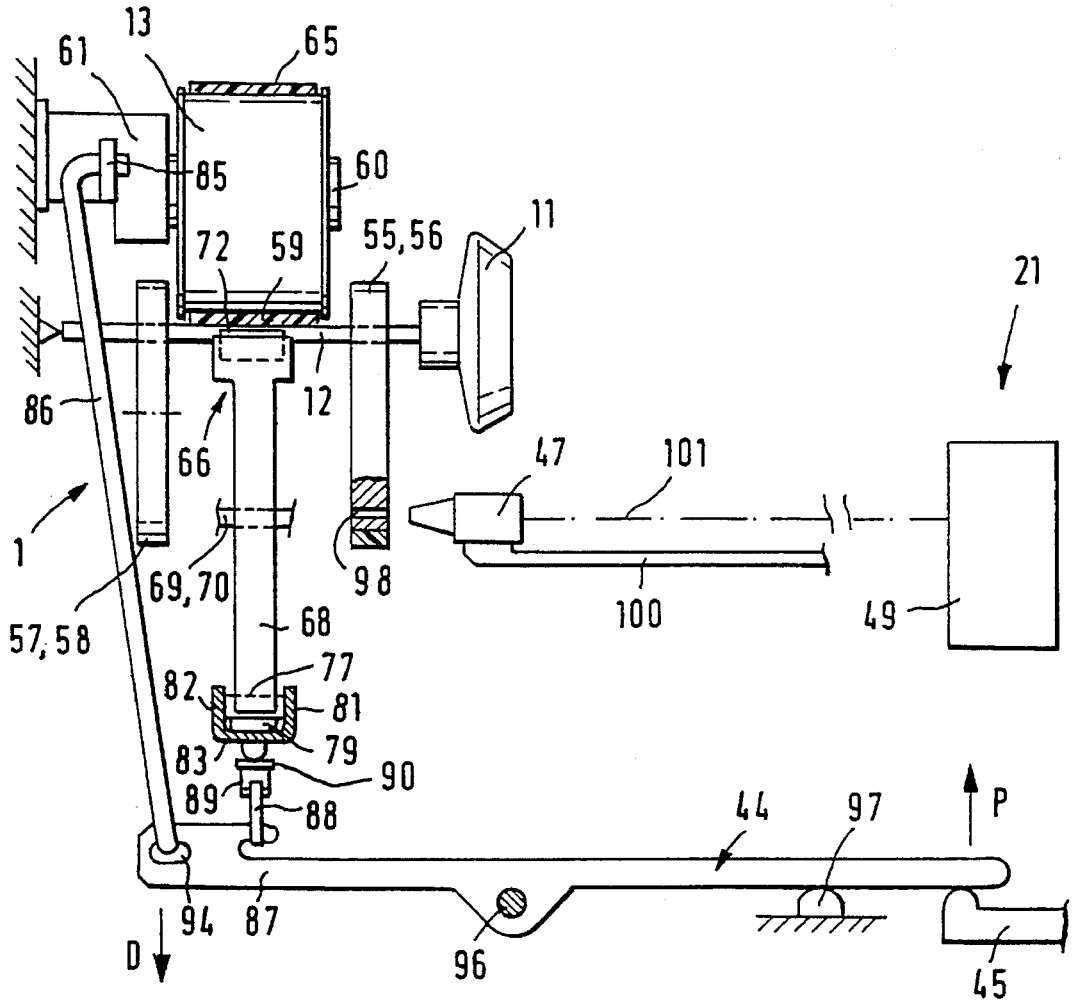
FIG. 4 shows a partly sectional schematic view in the direction of the arrow IV of FIG. 3, showing an impulse receiver attached to a plotting arrangement for establishing the current number of revolutions of the spinning rotor as well as a device for intermittent activating of the rotor brake.

In the following description of FIGS. 3 and 4 it will be explained by which means the actual piecing rotation speed 52 between the time points $t_a$ and $t_e$ can be attained. In the case of identical components, the same reference number is used in FIGS. 3 and 4 as in FIG. 1. In FIG. 3, the so-called rotor disk of the spinning rotor 11 is only represented by a broken line as it is located, from the point of view of the viewer, outside of the surface of intersection. The spinning rotor 11 comprises a shaft 12, which is supported in the wedges 54 from two supporting disk pairs, that is from two front supporting disks 55 and 56 as well as two back supporting disks 57 and 58. In FIG. 3, the drawing is represented so that on the left side of the shaft 12 a part of a back supporting disk 58 and a part of a front supporting disk 56 are recognizable. The shaft 12, lying horizontally in the wedges 54, is driven by a tangential drive belt 59 which extends in longitudinal direction of the machine (arrow A), and which drives the shafts 12 of all the spinning rotors 11 of the spinning aggregates 1 on one machine side. The supporting disks 55, 56, 57, and 58 are set in motion by the shaft 12, so that they rotate in the direction of arrows B and C. The tangential drive belt 59 rests on the shaft 12 from above and presses it into the wedges 54 of the supporting disk pairs so that the shaft 12 is secured in the wedges 54 during operation. The tangential drive belt 59 runs continuously at operational speed, that is as long as the open-end rotor spinning machine is in operation, therefore also during piecing at a spinning aggregate 1.

The tangential drive belt 59 is charged or pressed with a tension pulley 13 in the direction towards the shaft 12. The tension pulley 13 is arranged freely rotatable around an axle on a lever 61, which is pivotable around a fixed axle 62. A loading spring 63 rests on the lever 61, which spring charges the tension pulley 13 with a definite force due to prestress in the direction of the wedge 54. The loading spring 63, in the form of a leaf spring, is secured to a fixed gripping 64. The arrangement is so disposed that the tension pulley 13 also carries the returning end 65 of the tangential drive belt 59.

A rotor brake 66 is arranged at the spinning rotor 11, with which the shaft 12 can be fixed pincer-like and braked. This rotor brake 66 is arranged in between the supporting disk pairs in the area underneath the tangential drive belt 59, and is so constructed that no extra room is needed beside the tangential drive belt 59.

The rotor brake 66 contains two pincer arms 67 and 68, which are swivel-mounted around fixed axles 69 and 70 which extend parallel to the shaft 12, and are arranged underneath it. The arms of the pincer arms 67 and 68 turned towards the shaft 12 carry brake linings 71 and 72, which are applicable to the shaft 12 in such a way that they still comprise a movement component in the direction into the wedges 54.

The two symmetrically mirrored arms 73 and 74 of the pincer arms 67 and 68, turned away from the brake linings 71 and 72, are provided with sliding surfaces 75 and 76 which comprise an acute or obtuse angle between them, preferably an angle of a little less than 90°. The bisecting line of the angle between the sliding surfaces 75 and 76 extends through the axis of the shaft 12.

Between the two sliding surfaces 75 and 76 of the arms 73 and 74, a spreading element 77 can be pressed in, so that both arms 73 and 74 can be spread apart and the brake linings 71 and 72 positioned at the shaft 12. The retracting movement is effected by a bow-like spring 78 which is arranged between the arms of the Pincer arms 67 and 68 which carry the brake linings 71 and 72.

The spreading element 77 is formed as a cylindrical roller, which is made preferably from a wear-resistant plastic. The roller extends with its axis parallel to the shaft 12, and is supported by a plate 79, the said plate 79 being supported on a swivelling lever 80 in such a way that through its swivelling movement in an anti-clockwise direction the spreading element 77 is pressed deeper into the wedge of the sliding surfaces 75 and 76. The swivelling lever 80 comprises a U-shaped cross section, whose open side faces upwards. The spreading element 77, in the form of a roller, is guided with a slight axial gap between the two limbs 81 and 82. The plate 79, serving as a charging element, is fixed onto the web 83 of the swivelling lever 80.

The spreading element 77 in the form of a roller is supported respectively on the plate 79 and both sliding surfaces 75 and 76 in angular distances of 120°. It is otherwise freely movable, in particular in the movement direction of the arms 73 and 74. It is hereby ensured that the forces transferred by the roller to the pincer arms 67 and 68 and therefore by the brake linings 71 and 72 to the shaft 12 are balanced and are therefore equal.

The swivelling lever 80 is pivotable around a fixed axle 84, which extends parallel to the shaft 12, in such a way that the positioning movement of the roller extends into the bisecting line of the angle.

The activating of the rotor brake 66 is effected by an activating mechanism, which in addition effects a raising of the tension pulley 13 from the tangential drive belt 59 and thus reduces pressure on the tangential drive belt 59. There is, however, a short time span, which will be described later, in which the rotor brake 66 is already positioned at the shaft 12 and the tension pulley 13 is not yet released.

The lever 61 carrying the tension pulley 13 is connected to an arm 87 of the brake lever 44 by a pull rod 86 which is linked to a joint 85 of the lever 61, whereby the arm 87 is movable in arrow direction D when the rotor brake 66 is activated, namely when the brake lever 44 is raised in arrow direction P. The arm 87 of the brake lever 44 is linked to a leaf spring 90 by an intermediate member 88 as well as by a carrier 89, the spring 90 being prestressed to a particular level and fixed onto the web 83 of the swivelling lever 80 by a nut 91.

The shown non-operational position of the swivelling lever 80, into which it is pressed by means of the bow-like spring 78, is secured by a stop pin 92, which is arranged on the lever 80 and which comes to rest against a fixed stopper 93.

In a pulling movement in the direction of arrow D, the swivelling lever 80 is swivelled anti-clockwise around the axle 84, as this load is applied with a corresponding lever arm towards the axle 48. The spreading element 77 is thus pressed deeper between the sliding surfaces 75 and 76 So that the brake linings 71 and 72 are positioned at the shaft 12. As soon as the brake linings 71 and 72 are positioned at the shaft 12, all further movement in the direction of arrow D is absorbed by the leaf spring 90, so that the braking force is limited.

In a movement in arrow direction D, the lever 61 is pivoted by means of the pull rod 86 against the force of the loading spring 63 so that the tension pulley 13 is raised from the tangential drive belt 59. If the braking action is stopped, the swivelling lever 80 moves automatically back into its non-operating position. The prestressed leaf spring 90 ensures that the carrier 89 positions itself back onto the web 83 of the lever 80. The bow-like spring 78 presses the two pincer arms 67 and 68 apart, whereby the spreading element 77 is pushed back down between the sliding surfaces 75 and 76, until the stop pin 92 rests on the stopper 93. The loading spring 63 presses the lever 61 into the shown operational position again so that the tension pulley 13 charges the tangential drive belt 59 again.

In order to ensure that no undefined state for the shaft 12 occurs during the entire braking process, it is provided that the tension pulley 13 is moved away from the wedges 54 and the tangential drive belt 59 only when the brake linings 71 and 72 have already been positioned at the shaft 12. This is effected in a simple way in that a corresponding clearance is provided in the recess 94, where the pull rod 86 is connected by means of a bent end 95 with the arm 87 of the brake lever 44.

It should be mentioned that the two-armed brake lever 44 is pivotable around an axle 96 arranged on the spinning aggregate 1, and when in a non-operational position, it rests on a stopper 97.

When the spinning rotor 11 is braked, the brake lever 44 is thus raised from stopper 97. Piecing during the running up phase of the spinning rotor 11 is initiated by the brake lever 44 coming to rest on the stopper 97, whereby the rotor brake 66 releases the shaft 12. The tangential drive belt 59 is hereby laid with full force onto the shaft 12 and, as the tangential drive belt 59 is running at operational speed, the spinning rotor 11 is run up to its operational speed $n_B$. Because the particularly critical steps of the piecing process are carried out during the run up phase, it is intended that the current rotational speed of the spinning rotor 11 be measured, at least indirectly. According to the described embodiment, this is done by measuring the rotational speed of one of the front supporting disks 55, 56, namely supporting disk 56.

The front left supporting disk 56 in FIG. 3 is provided with two signal generators 98 and 99, which operate by means of magnetic field lines. In this case, the signal generators 98 and 99, formed as permanent magnetic pins, generate magnetic field lines. The permanent magnetic pins, which are flush with the front side of the supporting disk 56, are set into corresponding bore holes. When the supporting disk 56 rotates, a magnetic field is generated, which is in turn capable of generating an induction current in an impulse receiver 47. This impulse receiver 47 is, as already mentioned in connection with FIG. 1, a component part of the piecing device 21 which travels the length of the spinning aggregates 1, and can be positioned at the foremost front side of the supporting disk 56 to be scanned, in that impulse receiver 47, for example, is inserted by means of a movable rod 100 through a recess in the cover of the spinning aggregate 1. Alternatively, it is of course possible to arrange an impulse receiver at every spinning aggregate 1.

The distance between the impulse receiver 47 and the signal generators 98 and 99, formed as magnetic pins, measures preferably between three to six millimeters. The generated induction current is fed through an electrical power line 101 to the plotter 49 already mentioned, which plotter is located inside the piecing device 21, which is in turn connected to the program control 50 and thus to various control motors.

In the plotter 49, the current actual rotational speed of the spinning rotor 11 is compared to a preset value of the rotational speed $n_S$ which is suitable for piecing. When the difference in rotational speed between the compared speeds is sufficiently small, the most critical part of the piecing, namely the feeding back of the yarn end onto the fiber ring and the consequent drawing off, can be started. When the current rotational speed of the spinning rotor 11, corresponding to the course of curve 52 in FIG. 2, varies too much from the preset value of the rotational speed $n_S$, a command is given to the activating lever 45 of the piecing device so that the driving effect of-the tangential drive belt 59 is reduced or increased. The first command usually results in a reduction in the driving effect, that is in the raising of the brake lever 44 in arrow direction P. The rotor brake 66 is hereby positioned to the shaft 12, whereby the current rotational speed of the spinning rotor 11 is reduced. Before the rotational speed drops too far, the rotor brake 66 is released by lowering the activating lever 45, whereby the rotational speed increases again. During a predetermined time span, which is marked in FIG. 2 by the distance $t_a$ to $t_e$, the rotational speed fluctuates around the desired, and suitable for piecing, preset value of the rotational speed $n_S$ by means of intermittent braking and releasing of the rotor brake 66. The invention is based on the knowledge that a certain deviation from the preset value of the rotational speed $n_S$ either upwards or downwards is not damaging.

The rotational speed of the spinning rotor 11 during piecing is thus closed-loop controlled along a course controlled by the activating lever 45, which in turn is controlled by the motor 46. This course can be measured in such a way that the brake linings 71 and 72 are already positioned at the shaft 12, but the tension pulley 13 is not yet raised. The result is that the rotational speed does not drop too quickly. The activating of the rotor brake 66 can however be accompanied by a slight releasing of the tangential drive belt 59 by lifting the tension pulley 13.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A mobile piecing unit for controlling a piecing operation at a respective spinning unit of an open-end rotor spinning machine of the type having a plurality of adjacent spinning units driven by a common tangential belt drivingly engaging respective spinning rotor shafts, each spinning unit including a selectively operable rotor shaft braking device, said piecing unit being selectively movable to respective spinning units to perform a yarn piecing operation at the respective spinning unit and comprising:

rotational speed measuring means for measuring the rotational speed of ones of the respective spinning rotor shafts, rotational speed comparing means for comparing the rotational speed of the spinning rotor shaft with a predetermined piecing speed, and a closed loop rotor rotational speed control means for controlling a driving effect on the tangential belt on the spinning rotor shaft during piecing operations by repeated intermittent reducing and increasing of the driving effect of the tangential belt in response to measurement of respective rotational speeds above a predetermined high rotational speed and below a predetermined low rotational speed, said predetermined high and low rotational speeds being respectively above and below a predetermined ideal piecing speed.

2. A mobile piecing unit according to claim 1, wherein said rotational speed control means includes means for simultaneously moving the tangential belt with respect to the rotor shaft and applying the rotor shaft braking device to the rotor shaft.

3. A mobile piecing unit according to claim 1, wherein said rotational speed control means includes means for selectively applying the rotor shaft braking device to the rotor shaft and releasing the rotor shaft braking device from the rotor shaft.

4. Method of performing a yarn piecing operation at an open-end rotor spinning station of the type having a rotor, a rotor shaft supporting the rotor, a rotor shaft brake engageable with the rotor shaft, and a tangential driving belt engageable with the rotor shaft, said method comprising:

increasing the rotation speed of the rotor shaft by pressing the tangential belt against the rotor shaft while releasing the rotor shaft brake, determining when the rotor speed reaches a predetermined desired yarn piecing rotor speed by measuring the rotational speed of the rotor shaft conducting yarn piecing, operations at the spinning station, and performing a rotor speed regulating process after said desired yarn piecing rotor speed is reached to thereby maintain suitable yarn piecing rotor speeds during the piecing operations, wherein said rotor speed regulating process includes (i) comparing the actual rotor speed with a predetermined upper threshold value above the predetermined desired yarn piecing rotor speed and with a predetermined lower threshold value below the predetermined yarn piecing rotor speed, (ii) decreasing the driving effect of the tangential belt on the rotor shaft when the actual rotor speed reaches the upper threshold value, (iii) increasing the driving effect of the tangential belt on the rotor shaft when the actual rotor speed reaches the lower threshold value, and (iv) repeating steps (i), (ii) and (iii) during said yarn piecing operation.

5. A method according to claim 4, wherein said decreasing the driving effect includes actuating the rotor shaft brake and said increasing the driving effect includes releasing the rotor shaft brake.

6. A method according to claim 5, wherein said rotor spinning station is one of a plurality of adjacent spinning stations having a common constant velocity tangential belt driving their respective rotor shafts at operational rotor speeds above said desired yarn piecing rotor speed during normal spinning operations.

7. A method according to claim 6, wherein said measuring the actual rotational speed of the rotor shaft includes using magnetic field changes in rotating support disks which support a side of said rotor shaft which is opposite the tangential belt.

8. A method according to claim 6, wherein said rotor speed regulating process includes multiple intermittent decreasing and increasing of the driving effect to thereby maintain the actual rotor speed within a predetermined range bounded by the upper and lower threshold values for a predetermined piecing time period.

9. A method according to claim 4, wherein said rotor spinning station is one of a plurality of adjacent spinning stations having a common constant velocity tangential belt driving their respective rotor shafts at operational rotor speeds above said desired yarn piecing rotor speed during normal spinning operations.

10. A method according to claim 4, wherein said measuring the actual rotational speed of the rotor shaft includes using magnetic field changes in rotating support disks which support a side of said rotor shaft which is opposite the tangential belt.

11. A method according to claim 4, wherein said rotor speed regulating process includes multiple intermittent decreasing and increasing of the driving effect to thereby maintain the actual rotor speed within a predetermined range bounded by the upper and lower threshold values for a predetermined piecing time period.

12. A spinning machine system comprising:

an open-end rotor spinning station of the type having a rotor, a rotor shaft supporting the rotor, a rotor shaft brake engageable with the rotor shaft, and a tangential driving belt engageable with the rotor shaft, a presser for pressing the tangential belt against the rotor shaft while releasing the rotor shaft brake to effect increased rotational speed of the rotor shaft, measuring means for measuring the rotational speed of the rotor shaft to determine when the rotor speed reaches a predetermined desired yarn piecing rotor speed, and rotor speed regulating means for regulating the rotor speed during yarn piecing operations after said desired yarn piecing rotor speed is reached, said rotor speed regulating means including:

(i) rotor speed comparing means for comparing the actual rotor speed with a predetermined upper threshold value above the predetermined desired yarn piecing rotor speed and with a predetermined lower threshold value below the predetermined yarn piecing rotor speed, and (ii) means for intermittently decreasing and increasing the driving effect of the tangential belt on the rotor shaft in response to reaching of the respective upper and lower threshold values, thereby maintaining the rotor rotational speed within a predetermined range intermediate the upper and lower threshold values for a predetermined time to accommodate yarn piecing operations at the spinning unit.

13. A spinning machine system according to claim 12, wherein said means for intermittently increasing and decreasing the driving effect of the tangential belt includes means for actuating and releasing the rotor shaft brake.

14. A spinning system according to claim 12, wherein said rotor spinning station is one of a plurality of adjacent spinning stations having a common constant velocity tangential belt operable for driving their respective rotor shafts at operational rotor speeds above said desired yarn piecing rotor speed during normal spinning operations.

15. A spinning system according to claim 13, wherein said rotor spinning station is one of a plurality of adjacent spinning stations having a common constant velocity tangential belt operable for driving their respective rotor shafts at operational rotor speeds above said desired yarn piecing rotor speed during normal spinning operations.

16. A spinning machine system comprising:

an open-end rotor spinning station of the type having:

a rotor, a rotor shaft supporting the rotor, a variable driving effect drive assembly driving the rotor shaft and including a rotor shaft brake engageable with the rotor shaft, and tangential driving belt drivingly engageable with the rotor shaft, and a rotor speed regulator regulating the rotor speed during yam piecing operations after a desired yarn piecing rotor speed is reached, said rotor speed regulator including:

(i) a rotor speed comparer comparing an actual rotor speed with a predetermined upper threshold value above the predetermined desired yam piecing rotor speed and with a predetermined lower threshold value below the predetermined yarn piecing rotor speed, and (ii) a rotor speed controller intermittently decreasing and increasing the driving effect of the drive assembly in response to reaching of the respective upper and lower threshold values, thereby maintaining the rotor rotational speed within a predetermined range intermediate the upper and lower threshold values for a predetermined time to accommodate yarn piecing operations at the spinning unit.

17. A spinning machine system according to claim 16, wherein said rotor speed regulator includes means for actuating and releasing the rotor shaft brake.

18. A spinning system according to claim 17, wherein said rotor spinning station is one of a plurality of adjacent spinning stations having a common constant velocity tangential belt operable for driving their respective rotor shafts at operational rotor speeds above said desired yarn piecing rotor speed during normal spinning operations.

19. A spinning system according to claim 16, wherein said rotor spinning station is one of a plurality of adjacent spinning stations having a common constant velocity tangential belt operable for driving their respective rotor shafts at operational rotor speeds above said desired yam piecing rotor speed during normal operations.

* * * * *